US006224446B1

(12) United States Patent
Dietrich et al.

(10) Patent No.: US 6,224,446 B1
(45) Date of Patent: May 1, 2001

(54) CONTROL OF LEACHABLE MERCURY IN FLUORESCENT LAMPS BY ADDITION OF COPPER COMPOUNDS

(75) Inventors: David Key Dietrich, Schenectady; Donald Franklin Foust, Scotia; Deborah Ann Haitko, Schenectady, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/200,563

(22) Filed: Nov. 27, 1998

(51) Int. Cl.[7] ..... H01J 17/26
(52) U.S. Cl. ..... 445/2; 313/565; 313/639
(58) Field of Search ..... 445/29, 61, 73; 313/485, 490, 493, 546, 565, 642, 638, 639

(56) References Cited

U.S. PATENT DOCUMENTS

| | | | | |
|---|---|---|---|---|
| 5,229,686 | | 7/1993 | Fowler et al. | 313/565 |
| 5,229,687 | | 7/1993 | Fowler et al. | 313/565 |
| 5,994,838 | * | 11/1999 | Klinedinst et al. | 313/565 |

* cited by examiner

*Primary Examiner*—Michael H. Day
*Assistant Examiner*—Joseph Williams
(74) *Attorney, Agent, or Firm*—Toan P. Vu; Noreen C. Johnson

(57) ABSTRACT

The formation of leachable mercury upon disposal or during TCLP testing of mercury vapor discharge lamps is substantially prevented by adding soluble copper salts which are capable of being reduced to elemental copper which deposits on aluminum and other metal surfaces thereby inhibiting formation of oxidized forms of mercury by chemical reaction or amalgamation.

6 Claims, 2 Drawing Sheets

CONTROL OF LEACHABLE MERCURY IN FLUORESCENT LAMPS BY ADDITION OF COPPER COMPOUNDS

This invention is directed to mercury vapor arc discharge lamps in which the arc discharge takes place in mercury vapor, including conventional phosphor fluorescent lamps and to reduction of mercury pollution of landfills and ground water upon disposal of such lamps. More particularly the invention concerns prevention of formation of leachable mercury in disposal and testing procedures. Lamps made according to this invention are characterized by reduced solubilization and leaching of mercury when the lamp is pulverized for testing or upon disposal.

BACKGROUND OF THE INVENTION

Low pressure mercury arc discharge lamps are standard lighting means which include electrodes sealed in a glass envelope, the interior of which may be coated with a phosphor. The lamp also contains a small amount of mercury and an inert gas at low pressure, of about 1 to 5 torr. The term lamp, as used herein, means the complete unit including the glass envelope and the end pieces and plugs for mounting in a lamp fixture, and wires which connect the internal components of the envelope with the end pieces.

In manufacture of fluorescent or low pressure mercury arc lamps an amount of elemental mercury ($Hg^0$) is sealed in the lamp envelope. Most of the mercury adheres to the phosphor coating, a small amount being in the vapor phase.

During operation, alkali metal carbonates from the electrodes decompose and form free oxygen in the lamp. The oxygen may react with a portion of the mercury to form soluble mercury oxide (HgO). Soluble mercury oxide is leachable from land fills and other disposal facilities. Soluble mercury oxides or other oxidized forms of mercury are detrimental to the accuracy and reliability of the standard test for determination of the leachability of toxic materials from lamp waste. This test is generally referred to as the Toxicity Leaching Characteristic Procedure or TLCP test.

There is concern about the environmental impact of soluble mercury compounds which can leach into ground water sources, rivers, streams, and the like.

Elimination of soluble, i.e., leachable, mercury is a desirable result in the TCLP test and for the environment when lamps are disposed of in a landfill.

The formation of leachable mercury when fluorescent lamps are broken and exposed to landfill conditions can be prevented or minimized by preventing oxidation of metal components of the lamp. Certain metal components of fluorescent lamps particularly iron lead wires and any brass components generate ferric ($Fe^{+3}$) ions when exposed to moisture, oxygen, and acidity.

In order to address the growing concern that excessive amounts of mercury from disposal of fluorescent lamps might leach into surface and subsurface bodies of water, the Environmental Protection Agency has established a maximum concentration level for mercury at 200 parts per billion. This is generally determined by the standard analysis known as the Toxicity Characteristic Leaching Procedure (TCLP), a well known test procedure.

In carrying of the TCLP test, the lamps are pulverized to form lamp waste material similar to that which would result from lamp disposal in land fills or other disposal locations. The ambient conditions in such locations may be such as to promote formation of leachable mercury just as the TCLP test conditions themselves tend to allow for formation of leachable mercury in amounts greater than the established limit of 0.2 milligrams per liter.

It has been found that elemental mercury added to mercury-free pulverized lamp materials prepared for the TCLP test is converted to leachable mercury in the course of the test. If elemental mercury alone or in combination with various glass, phosphor, and other non-metal lamp components is tested, little or essentially no leachable mercury is found. When elemental mercury is tested in combination with metal lamp components such as iron lead wires, pins, or other metal hardware, the mercury has been found to be transformed into a leachable form.

It was determined by controlled experimentation that ferric iron (trivalent) is generated under the TCLP test conditions when carried out in the presence of oxygen and that this ionic species is able to oxidize elemental mercury to soluble mercury compounds which are measured as leachable mercury.

Corrosion or dissolution of metals from the metallic state requires the presence of both oxygen and a solvent such as water conditions that exist in the TCLP test and landfill situations. Accordingly, it has been found that the formation can be controlled or prevented by controlling or excluding exposure to oxygen of the iron containing metal lamp components.

The principles and practice of this invention will be more fully understood when considered in view of the following examples.

All TCLP test data was obtained by the test procedure prescribed on pages 26987–26998 volume 55, number 126 of the June 29, 1990 issue of the Federal Register.

Briefly, lamps being tested are pulverized into particulate form having the prescribed particle size which is capable of passing through ⅜ inch sieve. The test material is then extracted with a sodium acetate-acetic acid buffer at a pH of about 4.93.

To prevent the formation of leachable mercury upon disposal of mercury vapor discharge lamps and to improve the reliability of the TCLP test the formation of soluble iron is controlled by use of iron-free or low iron parts as components for lamp manufacture.

The effect of both soluble iron and copper on the formation of soluble mercury is evident from the data in Table 1, below. As the head space volume(available oxygen) increases, the amount of soluble mercury increases in response to the formation of increasing amounts of soluble iron (ferric) and copper.

TABLE 1

| | Head Space (mL) | Soluble Mercury (ppb) | Soluble Iron (ppm) | Soluble Copper (ppm) |
|---|---|---|---|---|
| 0 | 0.0000 | 210 | 3.62 | 0.35 |
| 1 | 140 | 214 | 4.63 | 0.40 |
| 2 | 205 | 203 | 5.04 | 0.63 |

Table 2, below, shows the effect of iron content on the formation of leachable mercury in the TCLP test procedure described above.

TABLE 2

| Fe mg | Leachable Hg ppm | Soluble Fe ppm |
|---|---|---|
| 0.2000 | 50.000 | 0.50000 |
| 1.1000 | 108.00 | 0.50000 |
| 10.100 | 158.00 | 3.2000 |
| 103.30 | 165.00 | 27.600 |

The object of the invention is to disclose a method to introduce soluble copper reagents that are capable of reducing upon the metal components of lamps in the TCLP test. The reduced forms of the copper salts that plate upon aluminum or other metal surfaces inhibit the generation of oxidized forms of mercury within the TCLP test.

SUMMARY OF THE INVENTION

The invention is a method for controlling formation of leachable mercury from mercury arc fluorescent lamps which comprises incorporation in the lamp of a water soluble copper containing compound in an amount sufficient to substantially prevent formation of leachable mercury by converting soluble mercury to elemental mercury.

The method of the invention is based on introduction of soluble copper reagents that are reduced and plated or deposited upon the metal components of lamps in the TCLP test. The reduced forms of the copper salts that plate upon aluminum or other metal surfaces inhibit the generation of oxidized forms of mercury by either chemical reduction or amalgamation so that mercury does not leach under the conditions of the TCLP test.

DESCRIPTION OF THE INVENTION

Figure 1:
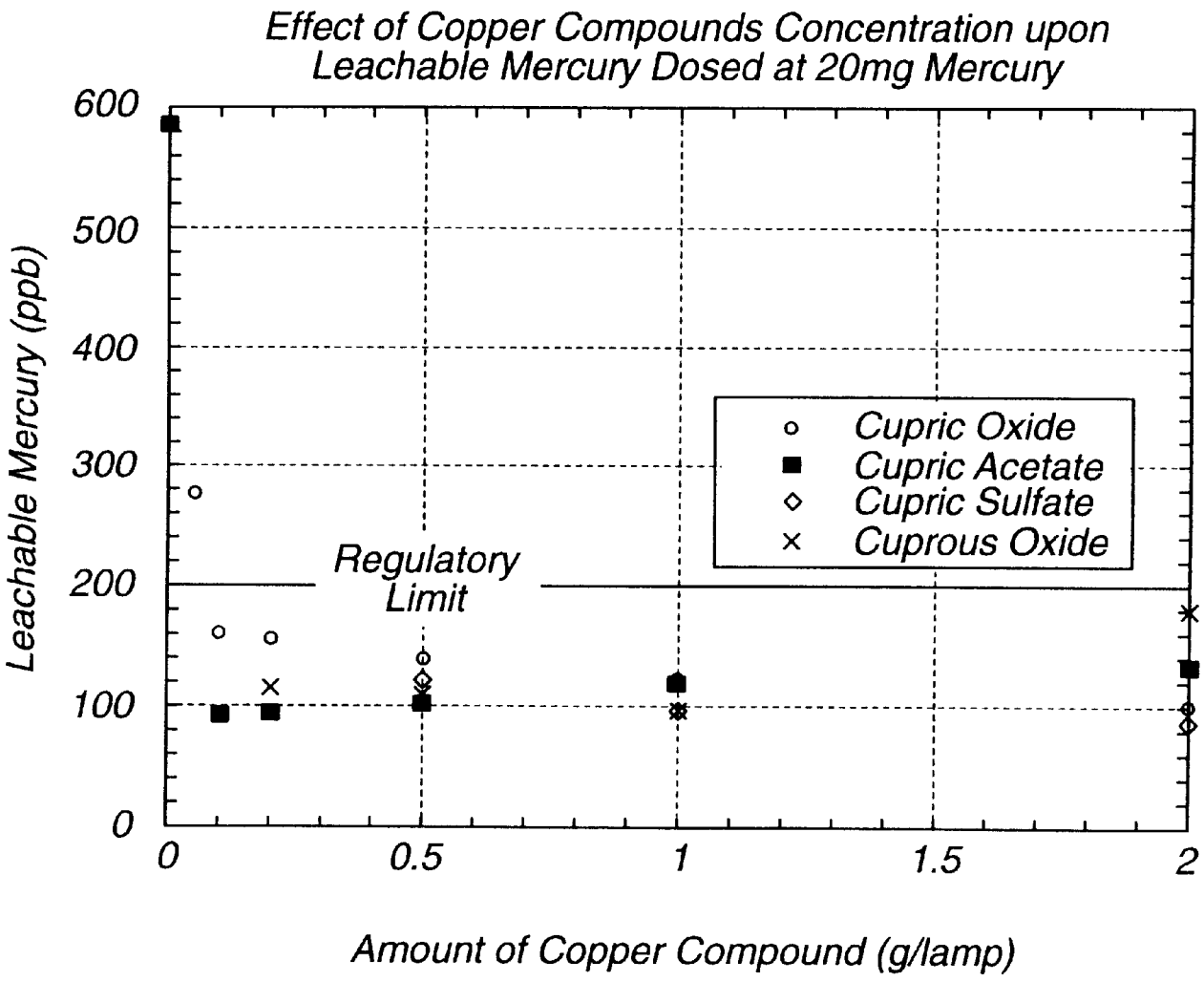
FIG. 1 is a graph showing the effect of various copper compounds and their concentrations on the amount of leachable mercury in a T12 Cool White/WattMiser lamp dosed with 20 mg mercury.

The formation of leachable mercury upon disposal or during TCLP testing of mercury vapor discharge lamps is substantially prevented by adding soluble copper salts which are capable of being reduced to elemental copper which deposits on aluminum and other metal surfaces thereby inhibiting formation of oxidized forms of mercury by chemical reaction or amalgamation.

Since discovering that elemental mercury added to undosed lamps generates leachable mercury in the TCLP test, we have been developing an understanding why mercury leaches under these conditions. If one tests elemental mercury alone or in combination with the glass or phosphor, from an undosed flourescent lamp, under TCLP conditions, no mercury leaches. It is only when elemental mercury comes in contact of the metal components in the lamp such as the copper or iron containing lead wires, brass pins, or other associated metallic hardware that mercury is transformed into a leachable form. It was determined by control experiments that both Fe+3 and Cu+1 are capable of generating oxidized forms of mercury that are leachable under TCLP conditions. It is known that complexing agents are capable of altering the oxidation/reduction potential of metals. By taking advantage of this chemistry, the Fe+3 and Cu+1 oxidation potential can be adjusted so that mercury will not react with these metals and leach in the TCLP test. Certain metallic compounds are capable of reducing oxidized forms of mercury to elemental mercury, however, incorporation into the lamp may be difficult since metallic compounds are not soluble in the TCLP medium. Taking advantage of the electrochemical potential differences between copper (1) or (2) salts and the metal components of the lamp produces a reaction that leaves finely divided copper metal upon the metal surfaces in the TCLP test. It is believed that the reaction between the copper compounds and the metal components of the lamp drives soluble mercury out of solution.

Table 4 shows the effect of some illustrative copper compounds on the TCLP test of lamps dosed with 20 milligrams of mercury. The first entry is a control showing the expected amount of leachable mercury generated if a lamp is dosed with 20 mg of elemental mercury. The leachable mercury generated in that case is 586 ppb in the absence of any soluble copper compound.

TABLE 4

| Copper Compound | Amount of Copper Compound gms | Leachable Hg ppb |
|---|---|---|
| None | 0.0 | 586 |
| CuO | 0.05 | 277 |
| CuO | 0.1 | 160 |
| CuO | 0.2 | 155 |
| CuO | 0.5 | 84 |
| CuO | 1.0 | 120 |
| CuO | 2.0 | 98 |
| $Cu_2O$ | 0.2 | 115 |
| $Cu_2O$ | 0.5 | 105 |
| $Cu_2O$ | 1.0 | 98 |
| $Cu_2O$ | 2.0 | 177 |
| Cu(II)Acetate | 0.1 | 94 |
| Cu(II)Acetate | 0.2 | 95 |
| Cu(II)Acetate | 0.5 | 98 |
| Cu(II)Acetate | 1.0 | 116 |
| Cu(II)Acetate | 2.0 | 132 |
| $CuSO_4$ | 0.2 | 156 |
| $CuSO_4$ | 0.5 | 117 |
| $CuSO_4$ | 1.0 | 98 |
| $CuSO_4$ | 2.0 | 85 |
| $Cu_2SO_3$ | 2.0 | 29 |
| $Cu_2SO_3$ | 1.0 | 38 |
| $Cu_2SO_3$ | 0.4 | 66 |
| $Cu_2SO_3$ | 0.2 | 81 |
| $Cu_2SO_3$ | 0.1 | 106 |

Leachable mercury generation in the TCLP test is dependent upon many factors, but perhaps one of the most important factors is mercury dose. Plots of the formation of leachable mercury with respect to dose do not exhibit linear behavior.

The effect of addition of varying amounts of copper compounds upon the dose response curve for a lamp dosed at 20 mg with elemental mercury is shown in FIG. 1.

Figure 2:
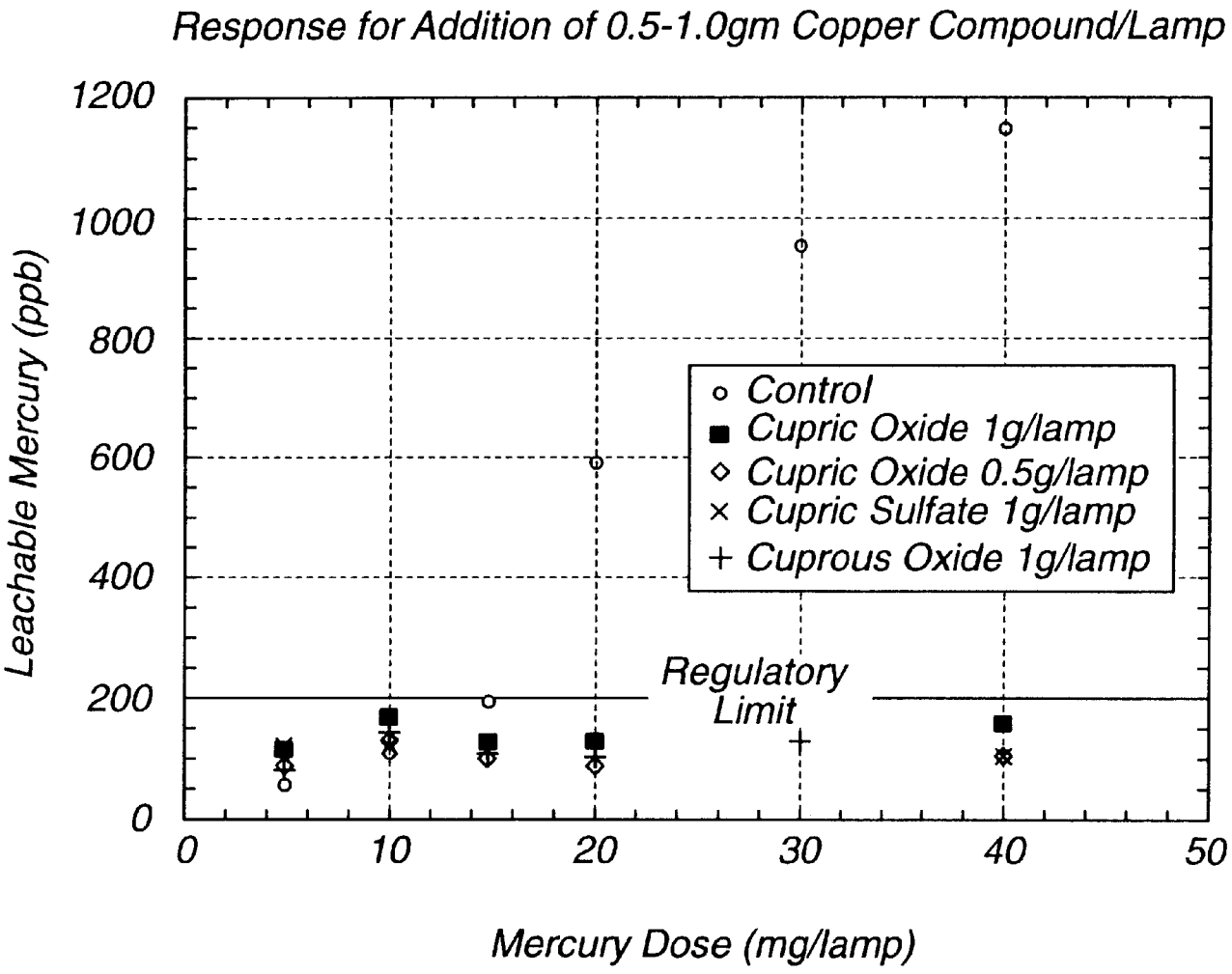
FIG. 2 is a graph showing the amount of leachable mercury from a T12 Cool White/WattMiser lamp dosed with various amounts of mercury upon addition of different amounts of cupric and cuprous oxide and cupric sulfate.

The effect of mercury dose on formation of leachable mercury for a given amount of copper compound is shown in FIG. 2.

What is claimed is:

1. A method for controlling a formation of leachable mercury from a mercury arc fluorescent lamp, said method comprising incorporating in the lamp at least one water-soluble copper-containing compound in an amount sufficient to substantially prevent the formation of leachable mercury by converting soluble mercury to elemental mercury.

2. A method according to claim 1 in which the copper compound is cupric oxide, cupric acetate, cupric chloride, cupric sulfate, or cuprous sulfite.

3. A method according to claim 1 in which the copper compound is present in an amount from about 0.1 to about 5 grams per lamp.

4. A method for preventing formation of leachable mercury during TCLP testing of a mercury containing fluorescent lamp which comprises incorporating in the lamp an amalgam forming amount of a copper compound.

5. A method for inhibiting formation of soluble mercury compounds during TCLP testing of mercury containing fluorescent lamp which comprises providing a source of copper ions which plate out of solution on active metal lamp parts as elemental copper and amalgamate elemental mercury.

6. A method for controlling a formation of leachable mercury from mercury arc lamps, said method comprising:

incorporating in the lamp at least one water-soluble copper-containing compound in an amount sufficient to substantially prevent the formation of leachable mercury;

depositing said at least one water-soluble copper-containing compound on metallic components of the lamp;

reacting said at least one copper-containing compound with the metallic components of the lamp to obtain a reduced form of copper;

converting oxidized mercury to elemental mercury on the reduced copper, thereby controlling the formation of leachable mercury.

* * * * *